US006715958B2

(12) United States Patent
Wittenberg et al.

(10) Patent No.: US 6,715,958 B2
(45) Date of Patent: Apr. 6, 2004

(54) FLOATING WAVE ATTENUATOR

(75) Inventors: Dan Wittenberg, Belcarra (CA); Mac McCallum, Richmond (CA)

(73) Assignee: 638731 BC Ltd., Delta (CA)

( * ) Notice: Subject to any disclaimer, the term of this patent is extended or adjusted under 35 U.S.C. 154(b) by 0 days.

(21) Appl. No.: 10/206,185

(22) Filed: Jul. 29, 2002

(65) Prior Publication Data

US 2004/0018056 A1 Jan. 29, 2004

(51) Int. Cl.[7] ..... E02B 3/06

(52) U.S. Cl. ..... 405/21; 405/25; 405/28; 405/31; 405/219; 114/266

(58) Field of Search ..... 405/21–23, 26–31, 405/34, 35, 219, 220, 302.6; 114/263, 266, 267

(56) References Cited

U.S. PATENT DOCUMENTS

| | | | | | |
|---|---|---|---|---|---|
| 3,691,774 | A | * | 9/1972 | Hard | 405/26 |
| 3,864,920 | A | * | 2/1975 | Tazaki et al. | 405/27 |
| 4,048,802 | A | * | 9/1977 | Bowley | 405/26 |
| 4,712,944 | A | * | 12/1987 | Rose | 405/26 |
| 4,715,744 | A | * | 12/1987 | Richey | 405/26 |
| 5,129,756 | A | * | 7/1992 | Wheeler | 405/23 |
| 5,304,005 | A | * | 4/1994 | Loeffler-Lenz | 405/26 |
| 5,347,948 | A | * | 9/1994 | Rytand | 114/263 |
| 5,707,172 | A | * | 1/1998 | Wilcox | 405/26 |
| 5,775,248 | A | * | 7/1998 | Simola | 114/267 |
| 6,102,616 | A | * | 8/2000 | Foote | 405/26 |
| 6,443,653 | B1 | * | 9/2002 | Zingale | 405/21 |

FOREIGN PATENT DOCUMENTS

| | | | | |
|---|---|---|---|---|
| FR | 2716219 | * | 8/1995 | |
| GB | 1559845 | * | 1/1980 | |
| GB | 2171062 | * | 8/1986 | 405/219 |

OTHER PUBLICATIONS

E. Douglas Sethness, Jr., "A Survey of Commercially Available Floating Breakwaters".

Abstract and claim 1 of U.S. Patent No. 5,429,452, Frost, issued Jul. 4, 1995.

Abstract and claim 11 of U.S. Patent No. 5,304,005, Loeffler–Lenz, issued Apr. 19, 1994.

Abstract and claim 1 of U.S. Patent No. 5,215,027, Baxter, issued Jun. 1, 1993.

Abstract and claim 1 of U.S. Patent No. 5,192,161, Helgesson, et al., issued Mar. 9, 1993.

Abstract and claim 1 of U.S. Patent No. 5,107,785, Baxter, issued Apr. 28, 1992.

Abstract and claim 1 of U.S. Patent No. 4,693,631, McKay, issued Sep. 15, 1987.

Abstract and claim 1 of U.S. Patent No. 4,406,564, Hanson, issued Sep. 27, 1983.

Abstract and Claim 1 of U.S. Patent No. 4,098,086, Desty et al., issued Jul. 4, 1978.

Abstract and claim 1 of U.S. Patent No. 4,023,370, Watson, issued May 17, 1977.

(List continued on next page.)

*Primary Examiner*—Jong-Suk (James) Lee
(74) *Attorney, Agent, or Firm*—Oyen Wiggs Green & Mutala

(57) ABSTRACT

This invention relates to a novel floating wave attenuator. More particularly, this invention pertains to a novel design of floating wave attenuator which has a curved vertical wave alternating wall section, a bottom vertical motion braking flange, and an air chamber for adjusting buoyancy. A floating wave attenuator comprising: (a) a wall having an exterior surface and an interior surface; (b) a flange associated with the wall and extending from at least one of the exterior surface and the interior surface of the wall; and (c) an air chamber in the interior of the wall, the air chamber being filled with air to adjust the buoyancy of the attenuator.

20 Claims, 8 Drawing Sheets

OTHER PUBLICATIONS

Abstract of U.S. Patent No. 3,864,443, A. Hopkins, Feb. 4, 1975.
Abstract of JP 60191073, Ishikawajima Harima Jukogyo KK, Sep. 28, 1985.
Abstract of GB 1559845, Shaw, Jan. 30, 1980.
Abstract of FR 2271345, Gass A, Jan. 16, 1976.
Abstract of JP 6305480, Mitsubishi Heavy Ind. Ltd., published Nov. 1, 1994.
Abstract of JP 2289713, Sanki Kogyo KK, published Nov. 29, 1990.
Abstract of JP 63138011, Kajima Corp., published Jun. 10, 1988.

* cited by examiner

FLOATING WAVE ATTENUATOR

FIELD OF THE INVENTION

This invention relates to a novel floating wave attenuator. More particularly, this invention pertains to a novel design of floating wave attenuator which has a curved vertical wave attenuating wall section, a bottom vertical motion braking flange, and an air chamber for adjusting buoyancy.

BACKGROUND

Floating breakwaters have been used for many years. Historically, a professional paper entitled "On Floating Breakwaters" was authored by Joly as far back as 1905. Perhaps the first major application of floating breakwaters was by the British during the Second World War. The Bombardon and Phoenix floating breakwaters were designed for use in the Normandy invasion of 1944. Notably, both were destroyed in a major storm.

In 1971, the United States Navy made a survey of floating breakwater concepts. The Navy found 106 different concepts that were either under current study, had been studied in the past, were in use, or had been used in the past.

Later, in 1981, the U.S. Army Corps of Engineers made a literature study of the then state-of-the-art in floating breakwaters. Although previous studies recognized at least sixty different groupings of floating breakwater concepts, the Corps study reduced the groupings further through geometric and functional similarities to ten major types of floating breakwaters. These major groups are:

(1) pontoon (2) sloping-float (inclined pontoon)

(3) scrap-tire (4) A-frame (5) tethered-float (6) porous-wall (7) pneumatic and hydraulic (8) flexible-membrane (9) turbulence-generator

(10) peak energy dispersion

Although these studies and reports appear to reference a large number of floating breakwater concepts and describe a number of prototype installations, the fact is that very few floating breakwater concepts have actually matured into a commercially available product.

General Breakwater Characteristics

Normally, one of two general physical principles can be used to explain the wave attenuating ability of a specific floating breakwater. The first is turbulence and the second is reflection.

The general characteristics of turbulence-type breakwaters are low draft, generally large width with respect to the wave size most effectively attenuated, and flexibility. The most obvious physical measurement of turbulence-generating breakwaters that directly relates to the effectiveness of this type of breakwater is its width. The width of a turbulence-type breakwater should generally be at least equal to 1.0 to 1.5 times the wave length of the design wave. More is better. It is normally not necessary for a turbulence-generating breakwater to be rigid, and in fact, most breakwaters are characterized by the flexibility of the entire breakwater system.

Perhaps the best well known turbulence-generating breakwater is the floating scrap-tire breakwater. It is made by connecting tires together and floating them with cubes of styrofoam. The floating scrap-tire breakwater attenuates waves through a loss of energy caused by the multiple openings and "traps" through which the water must pass to get to the lee side. Basically, the maze of channels exhausts the force of the wave on its way through the springs.

Another form of wave turbulence attenuation is caused by friction during the movement of water along the bottom of a large flat plate. This is how a large flat raft can be used to stop waves. The plate, or raft, must be somewhat rigid when used in this way, and must be very wide with respect to the design wave.

The second general mechanism used to stop waves is reflection. The best reflectors are probably bulkheads. When a wave hits a flat shoreline bulkhead, it is almost entirely reflected. A floating breakwater that uses reflection to stop waves must have characteristics similar to a shoreline bulkhead if it is to be as efficient. Reflective-type floating breakwaters do not need as much width as a turbulence-inducing-type floating breakwater. The key to the highly effective reflection characteristics of a shoreline bulkhead is the mass of earth behind the bulkhead which prevents the bulkhead from moving. Similarly, rigidity in the water is the key characteristic required of a floating breakwater that relies on reflection to stop waves. If the entire breakwater, or some component of the breakwater, is able to move significantly in the water, the wave attenuation capabilities of that reflective surface are greatly reduced.

A second characteristic required for effective operation of a reflective-type breakwater is depth penetration or draft. Without sufficient draft, much of the wave energy will pass below the breakwater and will rebuild waves on the lee of the breakwater. Thus, the two key criteria for effective operation of reflective-type breakwaters are rigidity, or lack of movement in the water, and depth penetration, or draft.

E. Douglas Sethness, Jr., President, Waveguard International, Austin, Tex., in an article entitled "A Survey of Commercially Available Floating Breakwaters", described the floating breakwater products, known to the author, that are commercially available on a continuing basis in the United States and Canada. According to him, these commercially available floating breakwaters can be divided between the following two general categories:

Reflective-type United McGill Cylindrical Float
- WAVEGUARD
- Meeco Hanging Panel
- Unifloat Caisson Turbulence-Generation Wallbreak
- Scrap-tire
- American Docks Raft-type The purpose of the Sethness article was to inform the marina or small boat harbor owner of the more important aspects of evaluating the use of a floating breakwater at a given site. The decision process that is presented in the article was intended to aid the owner or developer in understanding the location, engineering, expected performance, and risk/benefit analyses that should be an integral part of that evaluation.

According to Sethness, there is no substitute for properly understanding the breakwater site conditions. This first and most basic step is the one most generally glossed over in the process leading to the purchase of a floating breakwater system. A proper wind and wave analysis is crucial. Then, although there are generally understood requirements for marina construction, a set of specifications that defines the performance criteria for floating structures inside the marina must be developed. Understanding the structural and operational capabilities of the boats and marina facilities is extremely beneficial when defining the necessary performance characteristics of the breakwater. The third point that should be fully understood by a breakwater purchaser is the risk involved. A floating breakwater will not stop all of the waves, particularly freak waves. The proposed breakwater system should have some understandable means of scaling itself to the design wave. One size breakwater does not fit all conditions.

In conclusion, the Sethness article states that floating breakwaters are a practical means of solving some of the problems faced by marina and small boat harbor owners when they are required to expand into less well protected waters. Floating breakwaters may be the only alternative available for wave protection in areas that are environmentally sensitive, where there are boundary or navigation constraints, or where the water is very deep. However, as with many other things, a floating breakwater will perform only as well as the input, in terms of investigation time and engineering, that has preceded its installation.

A number of patents disclose various designs of floating breakwaters. These include the following:

| | Issue Date |
|---|---|
| U.S. Pat. No. | |
| 5,429,452 | Jul. 4, 1995 |
| 5,304,005 | Apr. 19, 1994 |
| 5,215,027 | Jun. 1, 1993 |
| 5,192,161 | Mar. 9, 1993 |
| 5,107,785 | Apr. 28, 1992 |
| 4,693,631 | Sep. 15, 1987 |
| 4,406,564 | Sep. 27, 1983 |
| 4,098,086 | Jul. 4, 1978 |
| 4,023,370 | May 17, 1977 |
| 3,864,443 | Feb. 4, 1975 |
| Foreign Patent No. | |
| GB 1559845 | Jan. 30, 1980 |
| FR 2271345 | Jan. 16, 1976 |
| JP 60191073 | Sep. 28, 1985 |
| JP 6305480 | Nov. 1, 1994 |
| JP 2289713 | Nov. 29, 1990 |
| JP 63138011 | Jun. 10, 1988 |

SUMMARY OF INVENTION

The invention is directed to a floating wave attenuator comprising: (a) a curved vertical wall having an exterior surface and an interior surface;(b) a flange associated with the wall and extending from at least one of the exterior surface and interior surface of the wall; and (c) an air chamber in the wall, the air pressure in the chamber being adjustable to govern the buoyancy of the wave attenuator. In alternative embodiments, the vertical wall can be straight or segmented.

The base flange of the attenuator can extend from the bottoms of both the exterior and interior surfaces of the curved vertical wall. The curved vertical wall can be hollow and at least part of the interior of the wall can be filled with a flotation material. The flotation material can be expanded polystyrene foam. The wave attenuator can include an air chamber below the flotation material in the interior of the curved wall. In alternative embodiments, the bottom face of the base may have irregular indentations to increase friction.

The intersections between the bases of the exterior and interior surfaces of the curved vertical wall and the base flange can be reinforced. The reinforcing members can be triangular shaped trusses which can be disposed at periodic locations along the length of the exterior and interior surfaces of the curved wall and base flange. The top surface of the curved vertical wall can be flat and can include a railing along its length.

The wave attenuator can be deployed on a body of water and can be anchored. The anchors can be secured to one or more of the triangular shaped trusses.

The expanded polystyrene foam can be of different density at different elevations in the interior of the vertical wall. The air chamber in the interior of the vertical wall can have one or more openings therein to enable water to circulate from outside into the air chamber.

Two or more wave attenuators according to the invention can be linked together in a serial pattern to form a breakwater which can be deployed on a body of water. The series of wave attenuators can be linked together in a consistent curved pattern so that the interior surfaces of the plurality of wave attenuators are all on one side and the exterior surfaces of the plurality of wave attenuators are on an opposite common side. The series of wave attenuators can be linked together so that the exterior and interior surfaces of each the wave attenuators in the series alternate in serial pattern along the length of the linked wave attenuators.

BRIEF DESCRIPTION OF DRAWINGS

In drawings which illustrate specific embodiments of the invention, but which should not be construed as restricting the spirit or scope of the invention in any way.

DETAILED DESCRIPTION OF SPECIFIC EMBODIMENTS OF THE INVENTION

Figure 1:
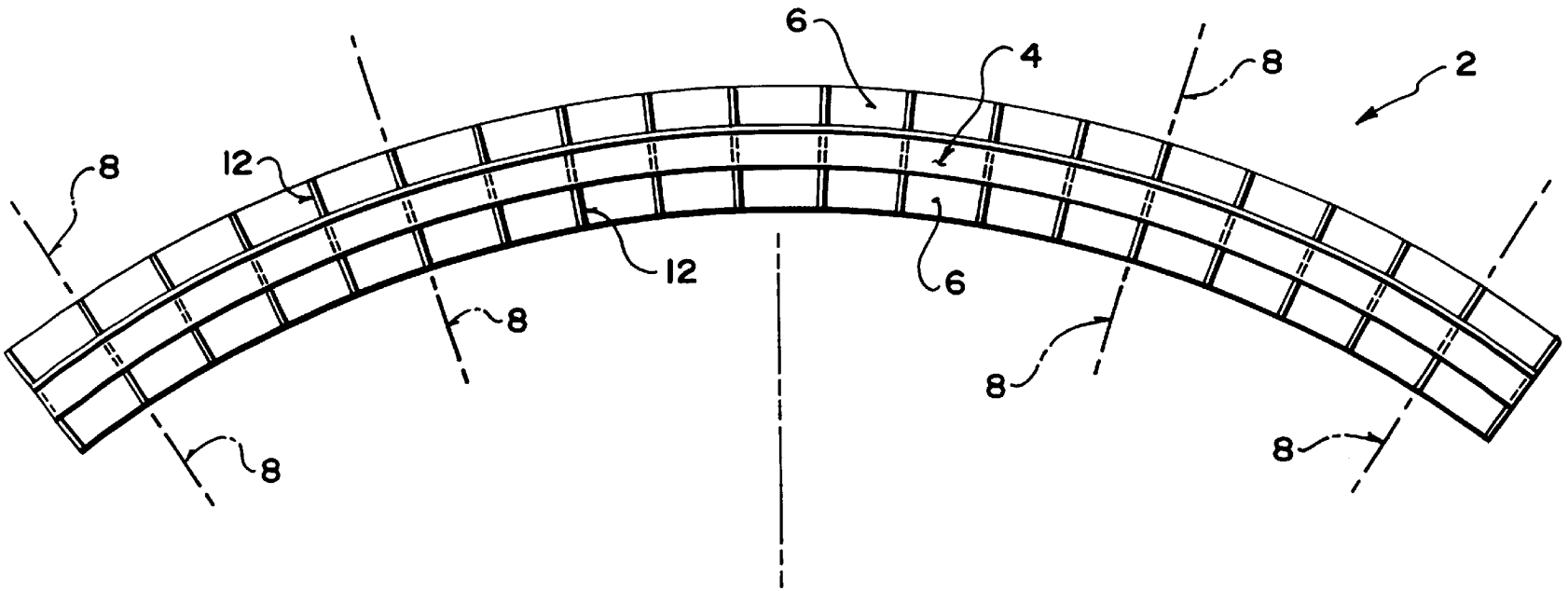
FIG. 1 illustrates a plan view of a first embodiment of the curved floating wave attenuator according to the invention.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

The wave attenuator according to the invention comprises a vertical floating member with a bottom vertical motion dampening base flange which is usually deployed in a horizontal direction, but can be of other effective orientations and designs. For instance, it may be at an angle. The base flange can also be curved or of any other shape that provides or enhances vertical motion dampening effect. The hollow vertical section is curved so that it dissipates or reflects waves while the base flange enhances entrained water mass, as well as reducing vertical and lateral motion of the attenuator. The vertical wave attenuator section may be curved in plan or angled or of some other suitable wave attenuating shape. Material for construction can vary but reinforced concrete or welded or riveted steel and expanded plastic foam would be the most common construction materials. The air flotation chamber can be constructed of concrete.

Flotation is provided by a suitable flotation medium such as expanded polystyrene (EPS) contained within a hollow formed in the interior of the vertical wall members. Entrained air can also be used as a supplement to reduce water absorption by the polystyrene foam over time and as a flotation adjustment to the attenuator. Air is at or below the hydrostatic pressure of the water at the bottom of the flotation chamber. Air pressure can be added or reduced to displace water and alter the buoyancy level of the structure. For deep vertical sections, a higher density of EPS can be used as pressures increase. The wave attenuator assembly is typically held in place with anchor lines or piling. Single attenuator sections may typically be up to 300 ft. in length and can be joined in series with other attenuator sections to provide a continuous elongated wave attenuating unit to satisfy a wide variety of criteria.

The curved attenuator sections have a number of advantages:

(a) The vertical wall and the stabilizing flange provide rotational stability (roll stiffness);

(b) The convex curved wave-side wall provides an offset pattern so that wave forces are distributed and dissipated outwardly along the length; and (c) The curved pattern increases lateral stiffness.

Many existing breakwater designs have high buoyancy, i.e. a high reserve buoyancy that causes the breakwater float unit to rise and fall with the wave, which motion is called "pumping". The attenuator design according to the invention has small reserve buoyancy compared to its inertial mass and therefore, because of the curved or bent vertical wall and the horizontal or angled base flange, has a reduced tendency to "pump".

The top of the breakwater can be used as a floating walkway or road. Parameters of the attenuator, such as wall height, flange width, and radius of curvature, can be varied to meet wave design conditions for specific installation sites. Specific variables are vertical member width and height, horizontal member angles and width, and radius of curvature.

Referring to the drawings, FIG. 1 illustrates a plan view of the curved-base flanged floating wave attenuator section according to the invention. As seen in FIG. 1, the curved wave attenuator 2 is constructed of a long curved vertical wall 4 with a base flange 6 extending inwardly and outwardly from the base of the wall 4. The curved wave attenuator 2 is held in place at the installation site by a series of anchors 8. The radius of curvature of the curved wave attenuator 2 is variable and is set according to wave characteristics and conditions prominent at the designated installation site for the curved wave attenuator. The curved wave attenuator section 2 illustrated in FIG. 1 is typically 300 feet in length and has a radius of curvature of 250 feet.

Figure 2:
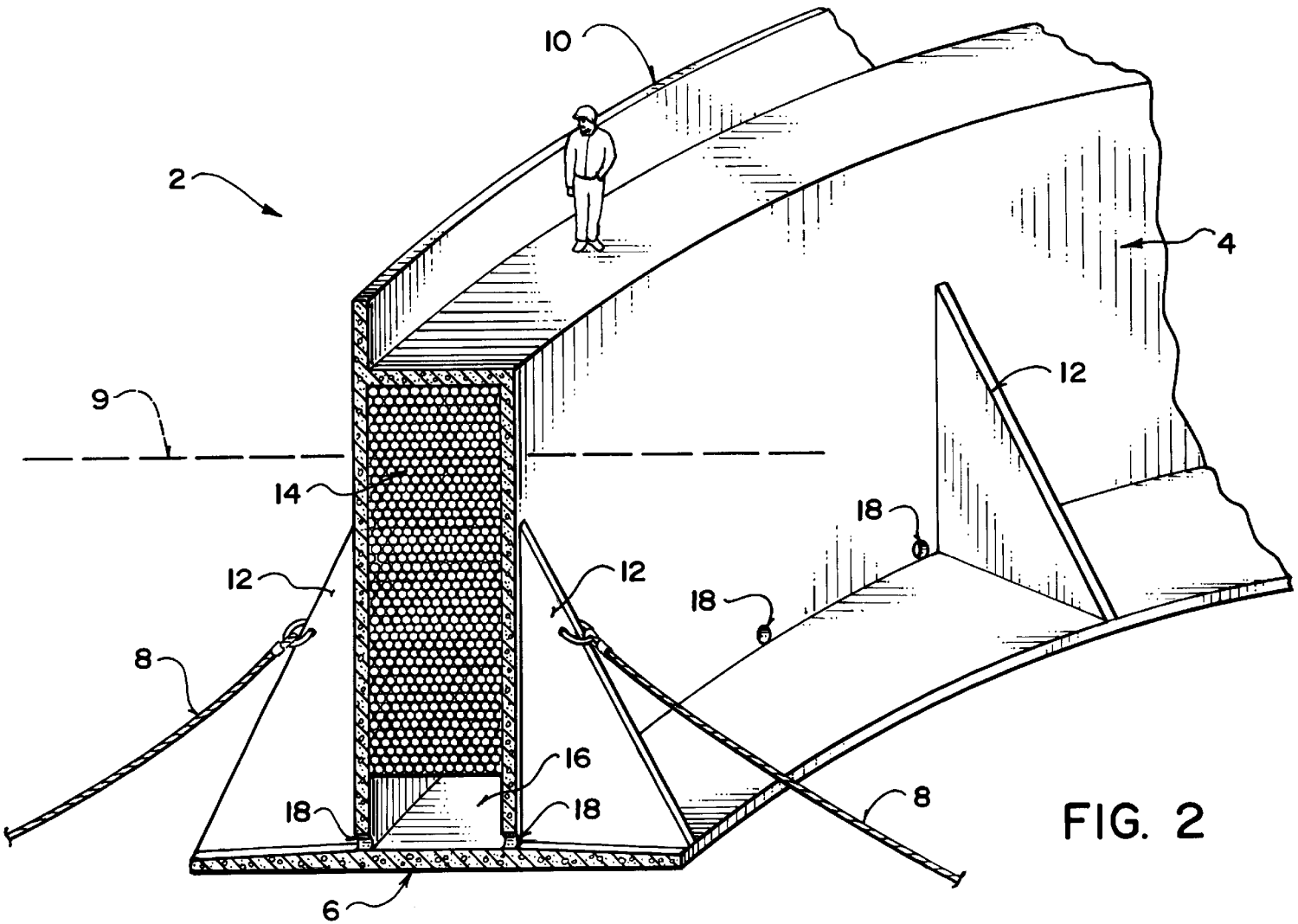
FIG. 2 illustrates an expanded partial isometric section-view of the curved floating wave attenuator according to a first embodiment of the invention.
Figure 3A:
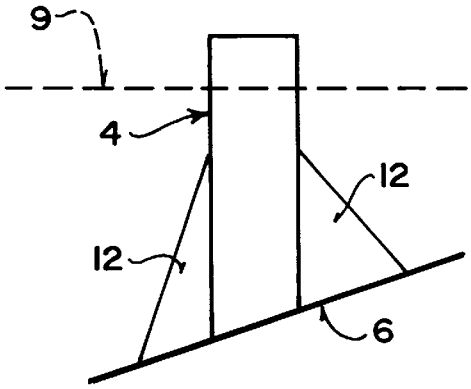
FIGS. 3*a*, 3*b*, 3*c*, 3*d* and 3*e* illustrate end views of five alternative embodiments of wave attenuators according to the invention.
Figure 3B:
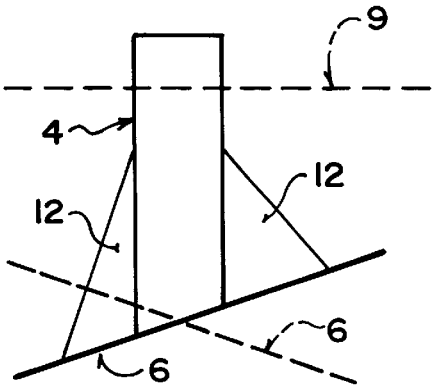
Figure 3C:
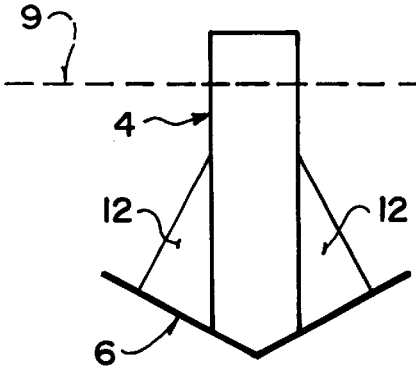
Figure 3D:
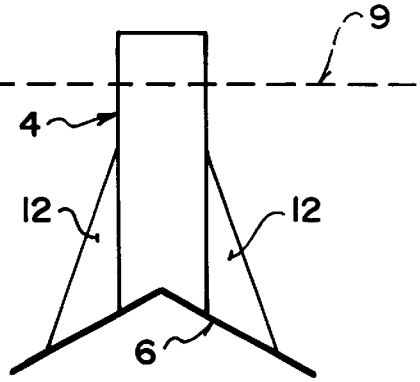
Figure 3E:
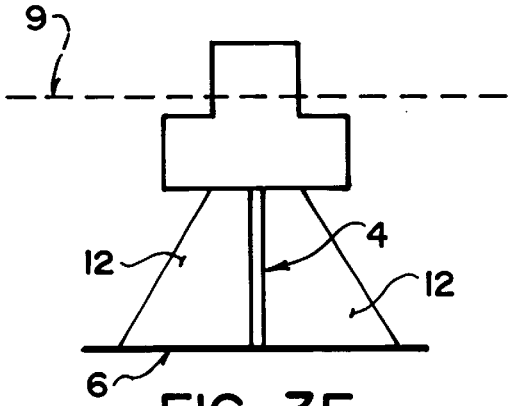

Referring to FIG. 2, which illustrates an expanded partial isometric section-view of the floating wave attenuator, the curved wave attenuator 2 is constructed of a hollow vertical curved wall 4 with inner and outer walls, both of which are connected at the base to a bottom flange 6. The flange 6 extends horizontally from both the exterior and interior edges of the base of the inner and outer walls of the curved vertical wall 4. The curved wall 4 has a railing 10 at the top. To give the viewer an indication of the size of the curved wave attenuator 2, a human figure is shown standing on the top of the wall 4. The base flange 6 is supported and secured to the curved wall 4 at a plurality of locations by a plurality of inner and outer triangular reinforcing trusses 12.

As seen in FIG. 2, the curved wall 4 is hollow and has expanded polystyrene foam 14 located in the hollow. This is for flotation purposes. The wall 4 and base flange 6 can be constructed of concrete, wood, steel, plastic, or some other suitable construction material. The expanded polystyrene foam 14 does not extend the total vertical height of the hollow interior of the wall 4. An air chamber 16 is maintained at the base of the interior of the curved wall 4, immediately below the foam 14 and above the upper face of the flange 6. The purpose of the air chamber is to enable the buoyancy of the curved wave attenuator 2 to be adjusted. It is also understood that the expanded polystyrene foam 14 can be of different densities to satisfy specific requirements for specific curved wave attenuators installed at specific locations. For instance, if the height of the curved wall 4 is great, and the curved wave attenuator 2 is disposed in water, the hydrostatic head exerted at the base of the inner and outer faces of the wall 4 will increase according to the depth. It may be advantageous, therefore, in specific applications, to have higher density and hence stronger foam disposed at the lower elevations of the interior of the curved wall 4. Thus, the denser, stronger foams disposed at lower elevations will withstand the greater hydrostatic forces that are exerted on the exterior and interior faces of the curved wall 4. Such forces would crush the polystyrene foam if a lighter, lower density foam is used.

FIG. 2 also illustrates a series of water inlets 18 disposed at various locations along the intersection of the base flange 6 with the bases of the inner and outer faces of the wall 4. This allows water to circulate into the interior of the air chamber 16, and flush it out from time to time. A further advantage is that the installer and the owner of the curved breakwater wave attenuator need not be concerned about water leaks into the interior of the air chamber 16. A further advantage of the air chamber 16 is that it will not fill up completely with water and hence exposure of the base of the EPS foam to water, for example, corrosive sea water, is avoided. Preventing contact of the polystyrene foam with water prolongs the life of the foam, and reduces maintenance costs.

A significant and unique advantage of the curved wave attenuator illustrated in FIG. 2 is that the curved arch design of the vertical wall 4 tends to disperse (offset) the force of the wave over a short period of time because wave contact does not occur simultaneously along all locations on the wall. For example, assuming that the curved wave attenuator is disposed so that its convex side is basically lateral to the direction of the wave action, the wave first impacts the central area of the curved wall and then subsequently, in a disbursed manner, impacts other locations on the wall progressing from the central area to the exterior regions of the curved wall 4. Thus, because the important curved design of the wall 4 tends to disperse the force of the wave over a short period of time, rather than suddenly, the tendency of the wall to "pump", "buck" or "rock" is not nearly as great as for floating wave attenuators that have straight vertical walls. The curved design of the wall of the wave attenuator 2 increases lateral stiffness.

A further significant and unique advantage of the curved wave attenuator 2, according to the invention, is that the base flange 6, by extending to both the exterior and the interior sides of the base of the wall 4, tends to trap water and hold the vertical wall 4 at a constant elevation, and thus resist upward or downward pumping movement of the overall curved wall attenuator 2. In other words, the base flange 6 acts somewhat as a "constructive" anchor for the curved wall 4. The flange 6, by capturing the water between it and the base of the wall, also tends to prevent or inhibit lateral movement of the base of the attenuator 2. The triangular reinforcing trusses 12 also ensure that the base flange 6 and the curved vertical wall 4 remain at right angles to one another. The reinforcing trusses also deter lateral movement of the wave attenuator 2.

FIGS. 3*a*, 3*b*, 3*c*, 3*d* and 3*e* illustrate end views of five alternative embodiments of wave attenuators according to the invention.

Figure 4:
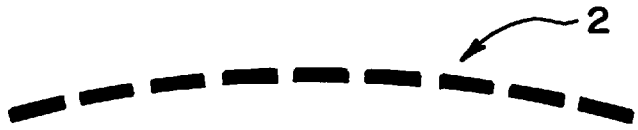
FIG. 4 illustrates a plan view of a first pattern for linking together a series of curved floating wave attenuators.
Figure 5:
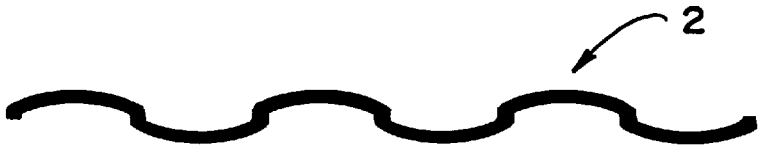
FIG. 5 illustrates a plan view of a second pattern for linking together a series of curved floating wave attenuators.

FIG. 4 illustrates a plan view of a first pattern for linking together a number of curved floating wave attenuator sections 2. This series can be extended to whatever length is required for a specific installation site. FIG. 5 illustrates a plan view of a second undulating pattern for linking together a number of curved floating wave attenuators 2. This undulating pattern may be preferable for locations where wave patterns and wave direction vary.

Figure 6:
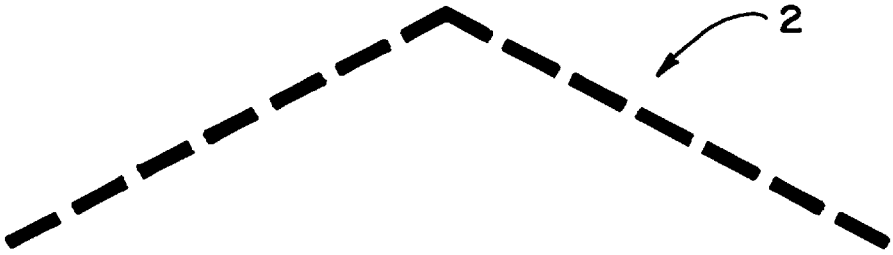
FIG. 6 illustrates a plan view of a third pattern for linking together a series of curved floating wave attenuators.
Figure 7:
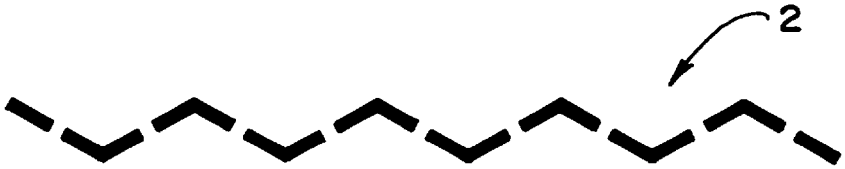
FIG. 7 illustrates a plan view of a fourth pattern for linking together a series of curved floating wave attenuators.

FIG. 6 illustrates a plan view of a third pattern for linking together a series of curved floating wave attenuators. FIG. 7 illustrates a plan view of a fourth pattern for linking together a series of curved floating wave attenuators.

It will be noted that the individual wave attenuator sections illustrated in FIGS. 6 and 7 are straight but because they are linked together in an angled or zigzag pattern, they present an uncommon front to the wave.

Figure 8:
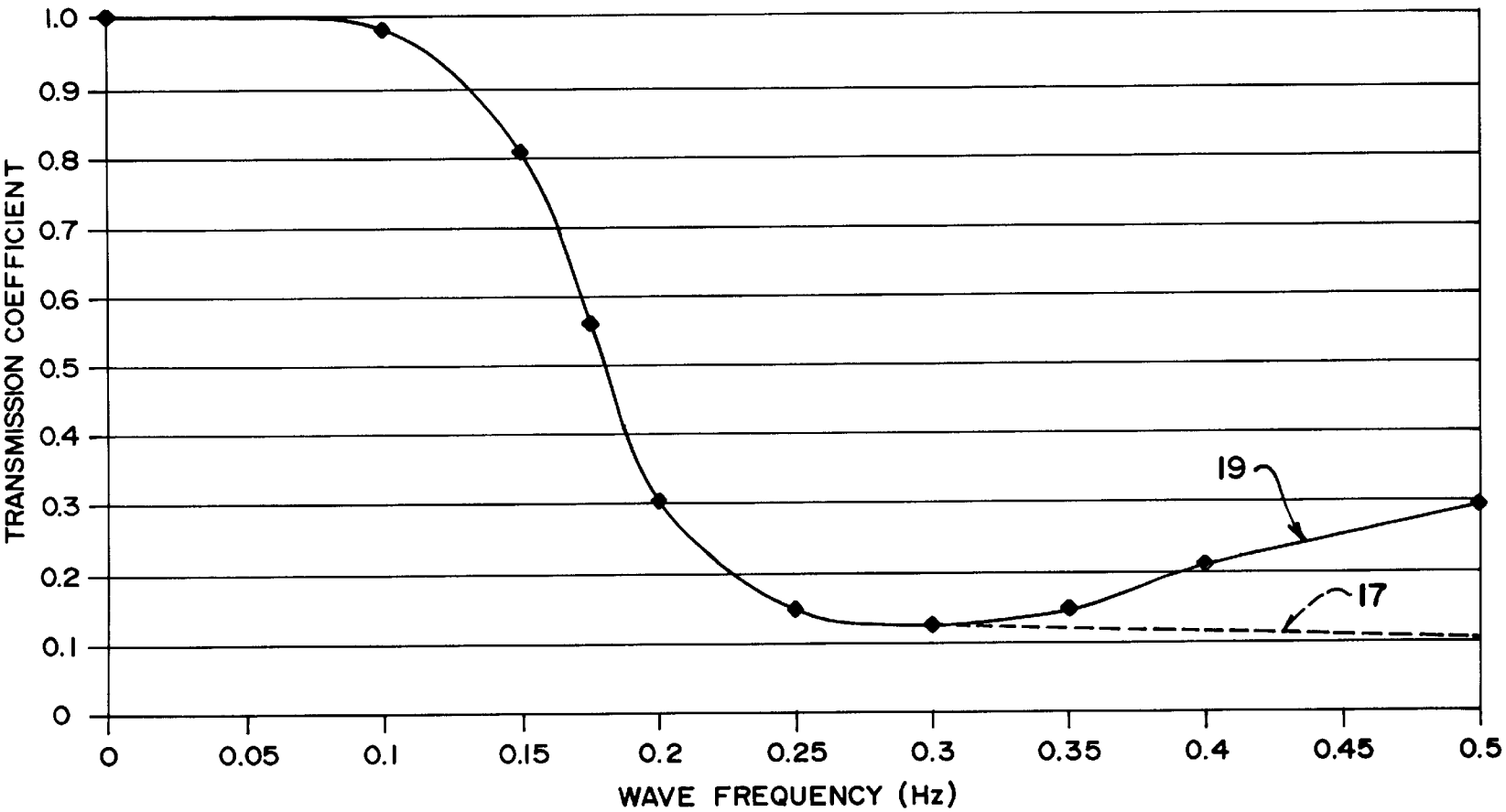
FIG. 8 illustrates a graph of a wave transmission coefficient plot for fixed structure depth of the wave attenuator.

FIG. 8 illustrates a graph of a wave transmission coefficient plot for fixed structure depth of the wave attenuator. The objective, for an effective wave attenuator, is to have the steep portion of the curve shown in the graph of FIG. 5 locate to the left as far as possible. Computer model test results indicate that the steep portion of the curve in the graph illustrated in FIG. 5 is about 0.1 Hz more effective than the curves for conventional well known floating wave attenuators. This is significant because it demonstrates that the performance of the wave attenuator 2 according to the invention is considerably superior to existing floating wave attenuators.

The graph illustrates for a given wave the percentage attenuation achieved at different wave frequencies or periods. Wavelength in feet equals 5.12 divided by the square of the frequency in seconds. Typically for floating wave attenuators high attenuation can be achieved at high frequencies with the effectiveness falling rapidly as the frequency reduces (or the wavelength increases). In this example, the attenuation is a useful 30% at 0.2 Hz frequency. Typical units available would achieve 30% at frequencies down to 0.3 Hz.

Figure 9:
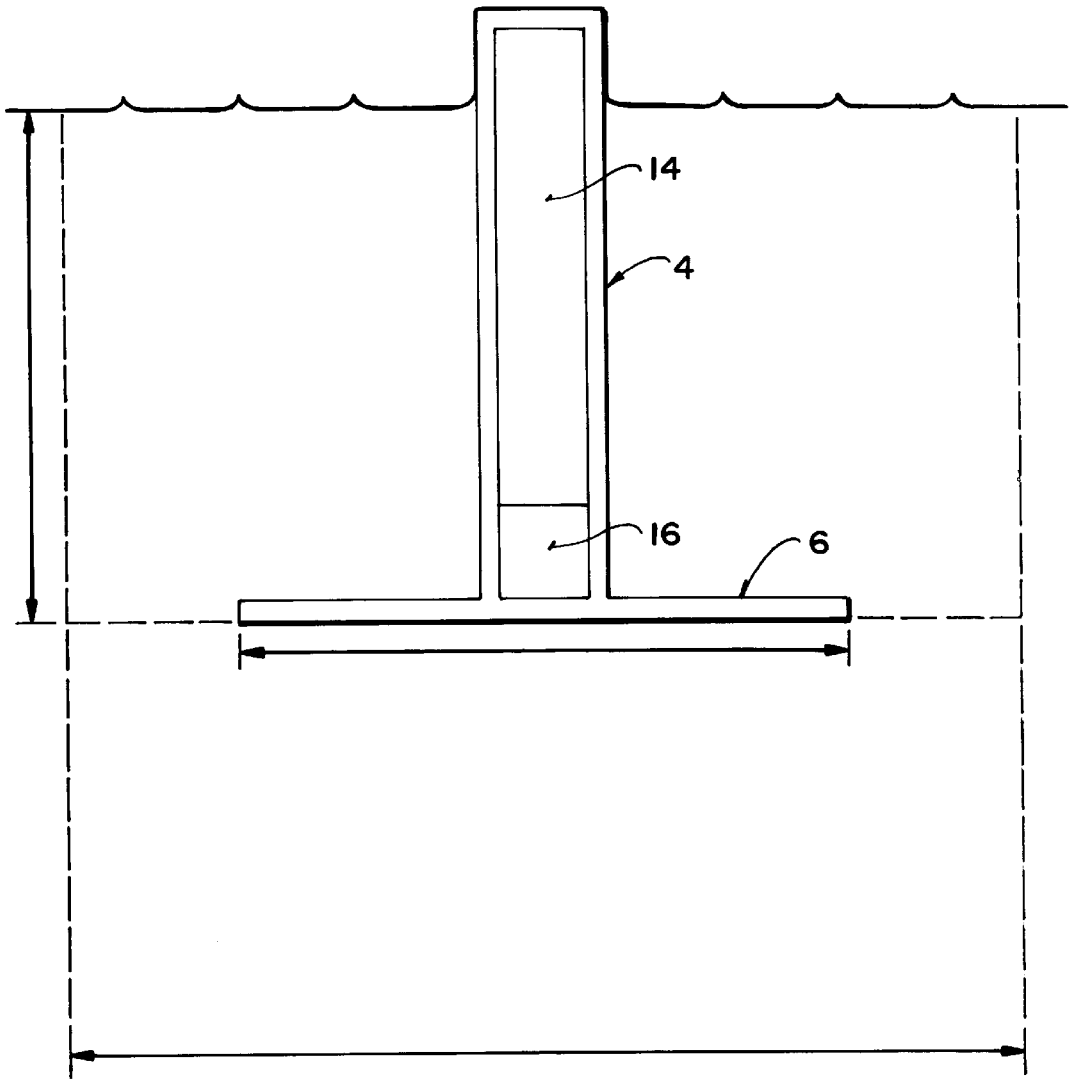
FIG. 9 illustrates a comparison of an end view of the wave attenuator according to the invention, and an equivalent conventional floating wave attenuator.

FIG. 9 illustrates an end view of a floating wave attenuator 2 according to the invention. It is compared constructively to a conventional box-type wave attenuator of much greater size, as indicated by the dotted lines. The overall effect of the combination of the curved wall 4 and the base flange 6, is much greater than the sum of its parts. For instance, a wave attenuator according to the invention, with a vertical submerged wall of 16 feet and a base flange of 20 feet is equivalent to a box-type floating wave attenuator measuring 16 feet in draft and 30 feet in width.

Figure 10:
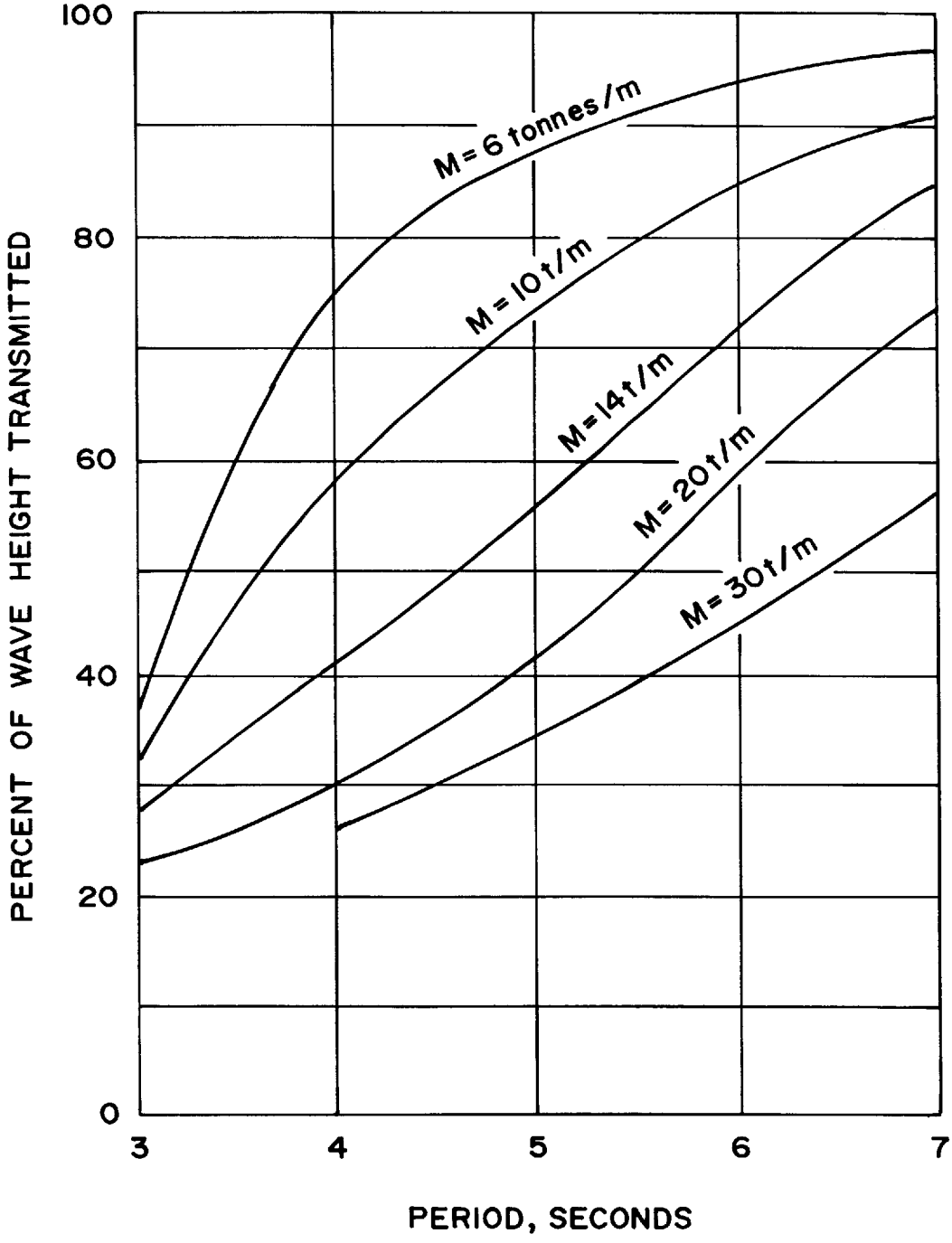
FIG. 10 illustrates a plotted curve of percent of wave height transmitted vs. period in seconds, for 5 meter water depth for a box-type caisson breakwater available in the prior art.
Figure 11:
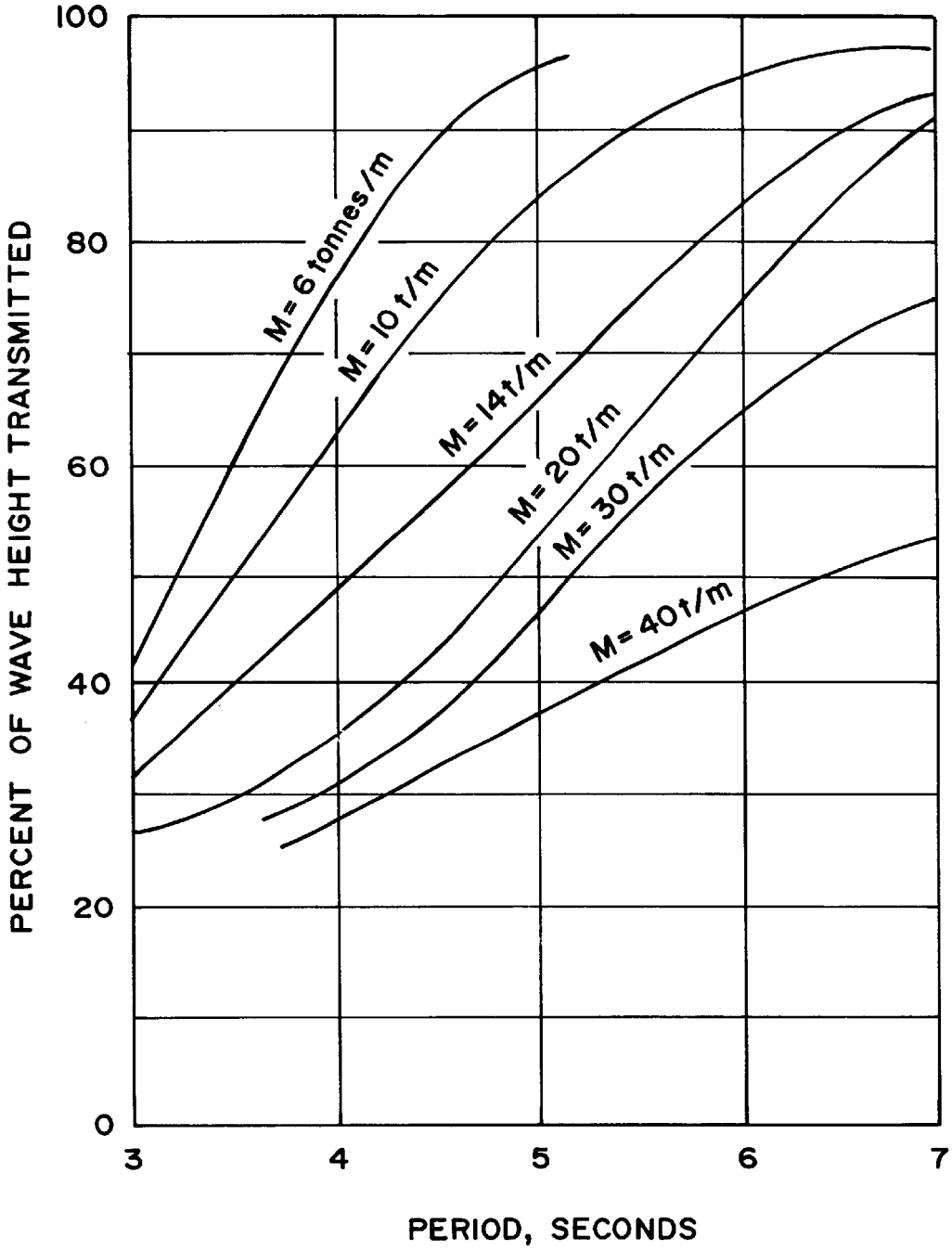
FIG. 11 illustrates a plotted curve of percent of wave height transmitted vs. period in seconds, for 7.5 meter water depth of the same box-type caisson breakwater.

FIG. 10 illustrates a plotted curve of percent of wave height transmitted vs. period in seconds, for 5 meter water depth for a box-type caisson breakwater available in the prior art. FIG. 11 illustrates a plotted curve of percent of wave height transmitted vs. period in seconds, for 7.5 meter water depth for the box-type caisson breakwater. These curves are taken from a report entitled "Floating Caisson Breakwater Design Parameters", prepared by Western Canada Hydraulic Laboratories Ltd., Port Coquitlam, British Columbia, for the Canadian Department of Fisheries and Oceans, Small Craft Harbours Directorate, January, 1985.

The objective is to determine a caisson cross-section that will achieve a 30% wave transmission of a wave with a 5 second period in an assumed water depth of 20 m.

The curves shown in FIGS. 10 and 11 are for 5 m to 7 .5 m water depth. A larger caisson cross-section will be required for a 20 m water depth than for a 7.5 m water depth, based on the trends shown in the attached figures for 5 m and 7.5 m water depths.

For a 5 second wave period, a mass of about 50 tonnes per meter is required to achieve about a 30% or lower wave transmission. This may be achieved by a caisson floating breakwater with a draft of about 4.9 m (16 ft.) and a beam of about 9.9 m (32 ft.), assuming a water density of 1,025 tonnes per cubic meter, and a beam/draft ratio of 2.

The curves shown in FIGS. 10 and 11 should be interpreted in association with the following notes:

Design Waves Considered

| | |
|---|---|
| T = 3 s | H = 0.5 m |
| T = 4 s | H = 0.8 m |
| T = 5 s | H = 1.2 m |
| T = 6 s | H = 1.8 m |
| T = 7 s | H = 2.5 m |

Centre of Gravity located at Waterline

Curves give preliminary estimates of breakwater transmission assuming breakwater width/draft=4.

The following reductions in percentage of wave height transmitted can be achieved by designing a breakwater width/draft ratio of 2 In 5 m water depth. Lesser reductions would be achieved in 7.5 m depth.

Table of Further Improvements for Designs Using Optimum W/C - 5 m Depth

| Period | 10 t/ln | 14 t/ln | 20 t/ln | 30 t/ln |
|---|---|---|---|---|
| 3 sec. | 4% | 4% | 5% | 5% |
| 4 sec. | 3% | 4% | 5% | 5% |
| 5 sec. | 2% | 3% | 4% | 4% |
| 6 sec. | 1% | 2% | 3% | 4% |
| 7 sec. | — | 1% | 2% | 3% |

The floating wave attenuator according to the invention has a number of important advantages over existing floating wave attenuators, all of which lend to its superior performance:

The vertical wall curvature provides for roll stiffness;

The curvature of the vertical wall provides for wave offset;

The curvature provides lateral stiffness;

The combination of the flat base plate flange and vertical curved wall section provides a wave attenuation pattern which is considerably greater than larger bulkier floating wave attenuators;

The low buoyancy to size ratio of the curved attenuator reduces vertical movement under wave action;

Air inclusion in the interior of the attenuator prevents water contact and EPS water saturation at depth;

The EPS density can be increased with depth as hydrostatic pressures increase.

EXAMPLE

Research using a wave computer model program was conducted on the effectiveness of a wave attenuator having the following characteristics. The wave attenuator is an EPS filled concrete rectangular cross-section tube with a 20 ft. wide concrete "flange" on the bottom. The wave attenuator is constructed in an arc with a radius of 250 ft. and extends a length of 300 ft.

Wave attenuator effectiveness is measured by transmission coefficient, which is the ratio of the wave height behind the attenuator as a factor of the natural wave striking the attenuator. (The term "attenuation factor" is sometimes used and is the reduction ratio—the two terms are complementary.) Transmission coefficients are greatly dependent on the wave length or frequency. Attenuation of a 5 second wave (128 ft. wavelength) is significantly more difficult than a 3 second wave (48 ft. wavelength). Transmission coefficient/frequency graphs typically show a similar shape where the attenuator rapidly loses effectiveness as the period increases. Maintaining the effectiveness for a longer period wave is the goal for an effective wave attenuator.

The model included calculations of the basic hydrostatic properties of the structure and numerical calculation of the wave transmission coefficients. Wave transmission coefficients for the structure were calculated by a two-dimensional wave diffraction program HAFB (Hydrodynamic Analysis of a Floating Breakwater). The program calculates the hydrodynamic properties of a 2D cross-section of a breakwater.

A graph of the wave transmission coefficient as a function of frequency for a fixed structure is illustrated in FIG. 8. The computations were preformed for a 20 meter water depth and a 1 meter wave height. The computed results indicate excellent performance of the structure, with a wave transmission coefficient of 0.3 at a frequency of 0.2 Hz (a 5 second wave period). For comparison, the wave transmission coefficient for the same structure without a bottom flange is 0.5, which is considerably less desirable.

A wave attenuator which is not restrained from moving will normally have a larger wave transmission coefficient. However, computations were not performed for a free curved structure because the roll stiffness and wave forces on the curved structure cannot be accurately modelled in 2D.

The roll stiffness of a 2D cross-section of the structure is very low, approaching zero, while the 3D structure has a larger stiffness in roll. Likewise, the roll moment due to waves is modified due to the curvature of the structure. These effects must be modelled in 3D. Nonetheless, the 2D computed results indicate that a floating wave attenuator according to the invention has superior performance. It is expected that a 3D computed model will demonstrate an even more superior performance because the unique curved structure of the invention will be taken into account.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A floating wave attenuator comprising:

(a) a wall having an exterior surface and an interior surface, said wall being curved in a horizontal direction;

(b) a flange associated with the wall and extending from at least one of the exterior surface and the interior surface of the wall; and (c) an air chamber in the interior of the wall, the air chamber being filled with air to adjust the buoyancy of the attenuator.

2. A wave attenuator as claimed in claim 1 wherein the flange extends from the base of the wall.

3. A wave attenuator as claimed in claim 2 wherein the flange extends from the bottoms of both the exterior and interior surfaces of the curved wall.

4. A wave attenuator as claimed in claim 1 wherein the is both curved in a horizontal direction and linear in a vertical direction.

5. A wave attenuator as claimed in clam 4 wherein the curved vertical wall is hollow and at least part of the interior of the wall is filled with a flotation material.

6. A wave attenuator as claimed in claim 5 wherein the flotation material is expanded polystyrene foam.

7. A wave attenuator as claimed in claim 6 wherein the expanded polystyrene foam is of different density at different elevations in the interior of the vertical wall.

8. A wave attenuator as claimed in claim 6 wherein the air chamber in the interior of the vertical wall has one or more openings therein which enable water to circulate from outside into the air chamber.

9. A wave attenuator as claimed in claim 5 including an air chamber below the flotation material in the interior of the curved wall.

10. A wave attenuator as claimed in claim 4 wherein the intersections between the bases of the exterior and interior surfaces of the curved vertical wall and the flange are reinforced.

11. A wave attenuator as claimed in claim 10 wherein the reinforcing members are triangular shaped trusses which are disposed at periodic locations along the length of the exterior and interior surfaces of the curved wall and base flange.

12. A wave attenuator as claimed in claim 11 wherein the top surface of the curved vertical wall is flat and includes a railing along its length.

13. A wave attenuator as claimed in claim 11 wherein the attenuator is deployed on a body of water and anchors are secured to one or more of the triangular shaped trusses.

14. A wave attenuator as claimed in claim 4 wherein the attenuator is deployed on a body of water and is anchored.

15. A wave attenuator as claimed in claim 1 wherein the curvature of the wall has a constant radius.

16. A wave attenuator as claimed in claim 1 wherein the flange is horizontal.

17. A wave attenuator as claimed in claim 1 wherein the flange is angled.

18. A breakwater formed by closely linking together with no significant gaps therebetween two or more wave attenuators as claimed in claim 1 in a serial pattern and deploying the breakwater on a body of water.

19. A breakwater as claimed in claim 18 wherein the series of wave attenuators are linked together in a consistent curved pattern so that the interior surfaces of the plurality of wave attenuators are all on one side and the exterior surfaces of the plurality of wave attenuators are on an opposite common side.

20. A breakwater as claimed in claim 18 wherein the series of wave attenuators are linked together so that the exterior and interior surfaces of each the wave attenuators in the series alternate in serial pattern along the length of the linked wave attenuators.

* * * * *